United States Patent [19]

Egli

[11] 4,428,485

[45] Jan. 31, 1984

[54] TEAR-OPEN CLOSURE FOR A DOUBLE BAG

[75] Inventor: Alwin Egli, Beringen, Switzerland

[73] Assignee: SIG Schweizerische Industrie-Gesellschaft, Neuhausen am Rheinfall, Switzerland

[21] Appl. No.: 294,002

[22] Filed: Aug. 18, 1981

Related U.S. Application Data

[63] Continuation-in-part of Ser. No. 44,207, May 30, 1979.

[30] Foreign Application Priority Data

Mar. 16, 1979 [CH] Switzerland ..... 2520/79

[51] Int. Cl.[3] ..... B43M 7/00; B65D 3/26

[52] U.S. Cl. ..... 206/604; 206/524.8; 206/632; 383/88; 383/94; 383/109

[58] Field of Search ..... 229/62; 206/610, 618, 206/619, 632, 524.8, 629

[56] References Cited

U.S. PATENT DOCUMENTS

| | | | |
|---|---|---|---|
| Re. 27,838 | 12/1973 | Leasure et al. | 229/62 |
| 2,678,154 | 5/1954 | Borchardt et al. | 229/62 |
| 2,983,430 | 5/1961 | Taylor | 229/62 |
| 3,149,772 | 9/1964 | Olsson | 229/62 |
| 3,339,820 | 9/1967 | Krzyzanowski | 229/62 |
| 3,439,866 | 4/1969 | Kuhnle | 229/62 |
| 3,638,389 | 2/1972 | Sherwood | 206/524.8 |
| 3,795,359 | 3/1974 | Rausing | 229/62 |
| 3,958,749 | 5/1976 | Goodrich | 229/62 |
| 4,027,455 | 6/1977 | Rausing et al. | 229/62 |

*Primary Examiner*—Joseph Man-Fu Moy
*Attorney, Agent, or Firm*—Spencer & Frank

[57] ABSTRACT

A dual bag has an inner liner and an outer wrap, a flatly pressed closing flap arranged in a face-to-face relationship with a top face of the bag. The flap has a closing ear at least at one of its ends. A transverse seam is provided in the closing flap along its outer bounding edge for sealing the bag. The closing flap is formed by portions of both the inner liner and the outer wrap and further, the transverse seam is located at a distance from the outer bounding edge of the closing flap. A cut extends into the closing flap from its outer bounding edge in the vicinity of at least one closing ear; the cut extends through both the inner liner and the outer wrap. Further, the distance of the transverse seam from the upper face of the bag is at least three times the width of the transverse seam.

8 Claims, 18 Drawing Figures

TEAR-OPEN CLOSURE FOR A DOUBLE BAG

CROSS-REFERENCE TO RELATED APPLICATION

This is a continuation-in-part of application Ser. No. 44,207 filed May 30, 1979.

BACKGROUND OF THE INVENTION

This invention relates to a double bag particularly for bulk goods and is of the type that is formed of an inner liner made of an airtight, heat-sealable material and an outer wrap. The bag has a flatly pressed closing flap provided with a transverse seal. The flat closing flap is folded onto an upper face of the bag and forms a closing ear at least on one side of the bag.

In single-wall bags it is known to fold the upper bag portion—which defines the bag opening—such that it forms a closing flap and to seal the closing flap by means of a transverse seam and further, to fold upwardly and inwardly the two lateral triangular ears of the closing flap. It is further known—as disclosed, for example, in Swiss Patent No. 487,040—to provide the upper edge of the closing flap with a tear-open notch. Although such a bag is easy to open, difficulties are encountered if it is desired to satisfactorily reclose the same.

There are further known double packages which have an impervious inner bag sealed by a transverse seam and an outer protective wrapper. Below the seam there is secured a flexible holding strip which, after simple or multiple longitudinal folding of the upper bag portion subsequent to initial opening, serves to maintain the bag in a reclosed position. Such an arrangement, which is disclosed, for example, in Swiss Patent No. 527,736 is expensive to manufacture because, for example, the outer protective wrapper has to be made separately.

SUMMARY OF THE INVENTION

It is an object of the invention to provide an improved tear-open closure for a double bag which can be manufactured in a simple manner and which provides that the bag, after the original opening thereof, can be reclosed sufficiently tightly, for example, for the purpose of preserving the flavor of goods contained therein.

This object and others to become apparent as the specification progresses, are accomplished by the invention, according to which, briefly stated, the flatly pressed closing flap at the upper portion of the bag is formed by both the inner liner and the outer wrap and further, the transverse seam is arranged at a distance from the outer edge of the closing flap and a slit or V-shaped notch is provided in the outer edge of the closing flap in the vicinity of a lateral closing ear of the closing flap. The distance of the transverse seam from the upper face of the bag is at least three times the width of the transverse seam.

The dual bag structured according to the invention requires the same manufacturing steps as a simple bag. Subsequent to opening of the dual bag by simply tearing off a portion of the closing ear, the bag can be reclosed by folding the closing flap onto itself and folding inwardly the remainder of the closing ear so that the contents are sufficiently sealed and are securely maintained inside the dual bag even if the bag tips over.

DESCRIPTION OF THE PREFERRED EMBODIMENTS

Figure 1:
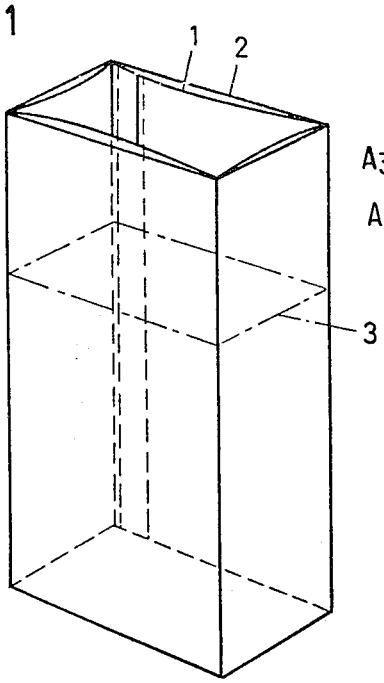
FIG. 1 is a perspective view of a dual bag subsequent to filling and prior to factory-closing.

Turning now to FIG. 1, there is shown a dual bag formed of an inner liner 1 which is made of a heat-sealable, airtight material and an outer wrap 2 which may be made of paper or aluminum and which can be readily printed on. FIG. 1 shows the dual bag in a still-open state, that is, before the sealing operation is performed thereon as part of the packaging process. The making of the dual bag as shown in FIG. 1 is conventional and thus does not form part of the invention. The upper level of the contents of the bag, such as ground coffee, is indicated at 3. The two upper edges of the inner and outer bags are approximately at the same height level.

Figure 2:
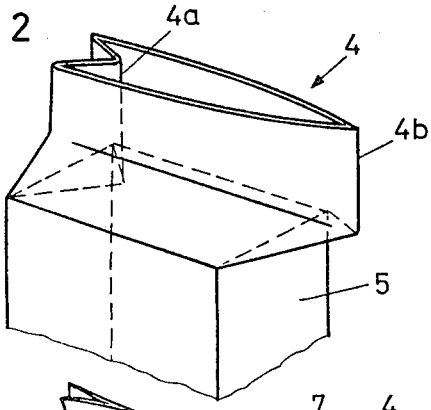

Turning now to FIG. 2, there is illustrated the formation of the upwardly extending closing flap 4 which is to be subsequently sealed by a transverse seam. One vertical edge 4*a* of the closing flap 4 is folded inwardly to thus form a pinched fold, while another vertical edge 4*b* projects beyond the vertically oriented lateral wall 5 of the bag.

Figure 3:
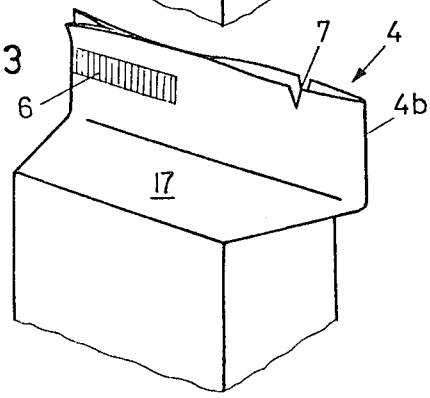
Figure 16:
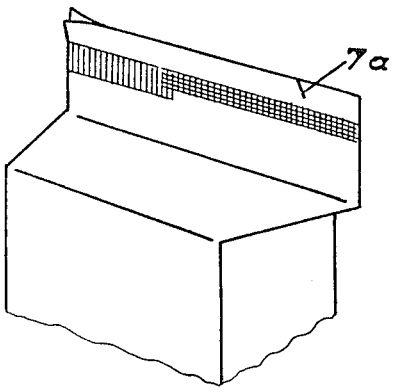
FIG. 16 is a perspective view similar to FIG. 4, illustrating a modification.

Turning now to FIG. 3, the pinched fold 4*a* is sealed by a first partial transverse seam 6 extending only along one part of the length of the closing flap 4. Simultaneously, both the inner liner 1 and the outer wrap 2 are together provided with a V-shaped notch 7 in the vicinity of the edge 4*b* in the outer edge 4*c* of the closing flap 4. As an alternative to a V-shaped notch 7, it is feasible to provide a simple slit 7*a* as shown in FIG. 16. In this phase of the package making, the bag is evacuated and the second portion 8 of the transverse seam is provided under vacuum as illustrated in FIG. 4.

It is of significance that the transverse seams 6, 8 do not include the upper edge 4*c* of the closing flap 4, but are situated at a distance $A_1$ therefrom. Thus, the notch 7 (or slit 7*a*) extending inwardly from the upper edge 4*c* does not project into the zone of the transverse seams 6, 8, but occupies in its entirety a non-sealed zone of the closing flap 4. This arrangement has at least two advantages: the seams 6, 8 are not weakened by a cut interrupting transversely their continuity and further, a tearing at the notch 7 during the opening operation is facilitated if first only non-sealed flap areas need to be severed.

Further, according to the invention, the minimum width $A_2$ of the non-sealed zone of the closing flap 4, measured from the upper face 17 of the dual bag to the closest transverse edge of the seams 6, 8 is at least three times the maximum width $A_3$ of the seams 6, 8. Such a relationship is advantageous, because the eventual tear line 16 (FIG. 13) upon opening of the bag will extend at a substantial distance from the level 3 of the contents (FIG. 1), whereby spilling of the contents during opening may be easily avoided. It is a further advantage that despite a substantial distance of the tear line 16 from the level 3 of the contents, a large opening area 15 (FIG. 12) is provided which ensures a rapid and easy pouring of the contents. The above-described relationship between dimensions $A_2$ and $A_3$ also has advantages which manifest themselves during manufacture. Thus, by virtue of the significant distance $A_2$ from the level 3 of the contents, soiling of the packaging material is reduced, thereby ensuring a superior sealing effect for the transverse seams 6, 8.

Figure 4:
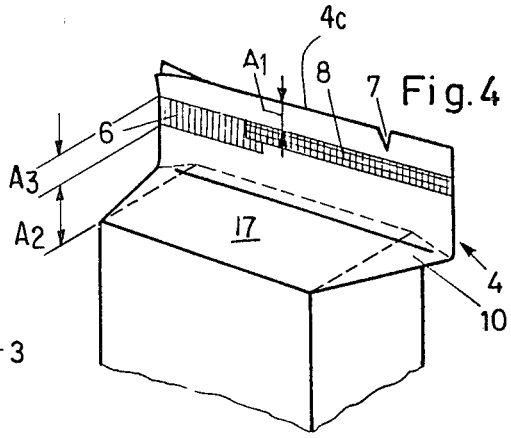
FIGS. 2 through 8 are perspective views of the upper part of the dual bag illustrating the consecutive steps for providing thereon a tear-open closure according to a preferred embodiment of the invention.
Figure 5:
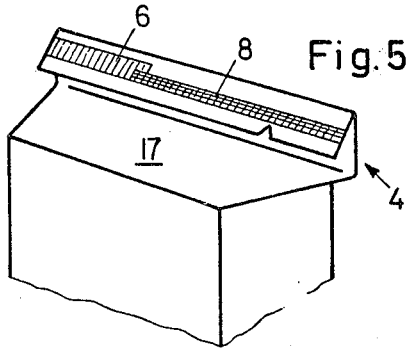
Figure 6:
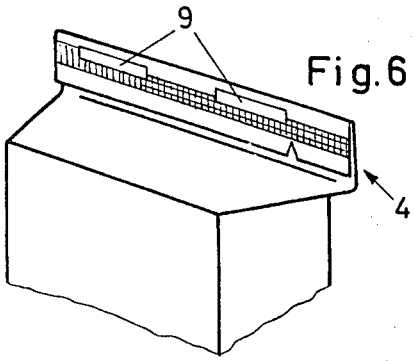
Figure 7:
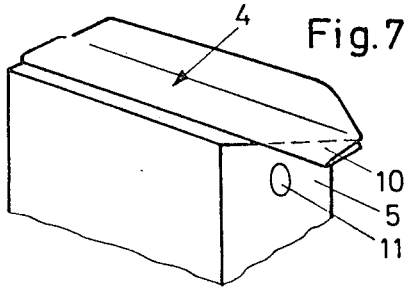
Figure 8:
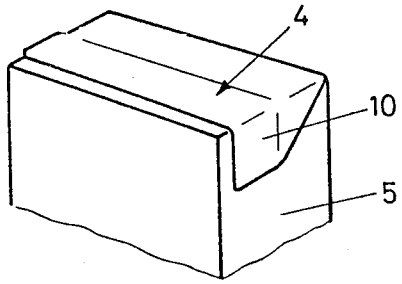

Turning now to FIG. 5, subsequent to the steps which result in the configuration shown in FIG. 4, that portion of the closing flap 4 which carries the transverse seam 6, 8 is folded over lengthwise and is, as shown in FIG. 6, provided with an adhesive 9. Thereafter, the once folded-over closing flap 4 is folded further downwardly lengthwise onto the upper face 17 of the bag, whereby the adhesive portions 9 bond the closing flap 4 to the bag. This phase is depicted in FIG. 7. Thereafter, the ourwardly projecting lateral closing ear 10 is folded downwardly onto the lateral wall 5 of the bag, to which it is bonded by an adhesive 11. FIG. 8 shows the upper part of the bag in its closed, finished state.

Figure 17:
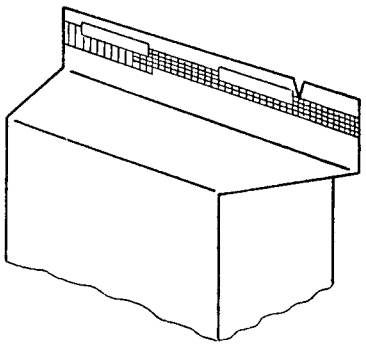
FIGS. 17 and 18 are perspective view similar to FIGS. 6 and 7, respectively, illustrating a modification.
Figure 18:
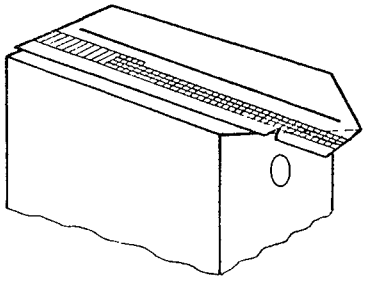

It is to be understood that as an alternative it is feasible to fold the flatly pressed closing flap 4 directly onto the upper face of the bag (and to bond it thereto) without a prior preliminary longitudinal folding (as it has been done according to FIG. 5). Such an alternative is illustrated in FIGS. 17 and 18 showing, respectively, the closing flap prior to and subsequent to its pressing onto the upper face 17 of the bag.

Figure 9:
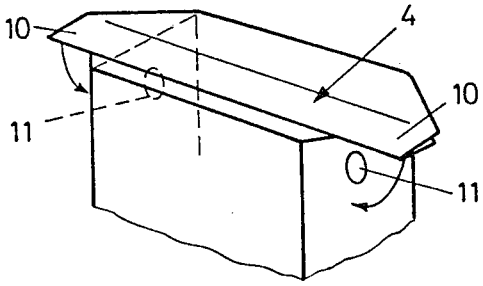
FIGS. 9 and 10 are perspective views of two further preferred embodiments.
Figure 10:
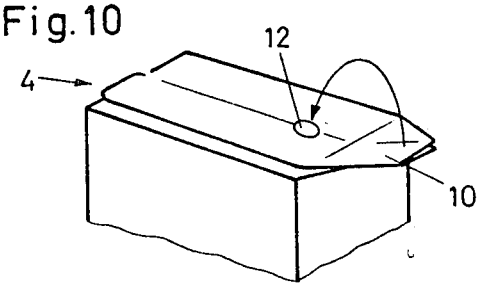

Turning now to the alternative shown in FIG. 9, terminal ears 10 are provided on both ends of the closing flap 4. This then means that the bag is not provided with a pinch fold **4*a* as was the case in the previously described embodiment. According to another variant (shown in FIG. 10), the ear or ears 10 are folded onto the closing flap 4 and secured thereto by an adhesive 12 rather than folding them down onto the side of the bag as it was described in connection with FIGS. 7 and 8**.

Figure 12:
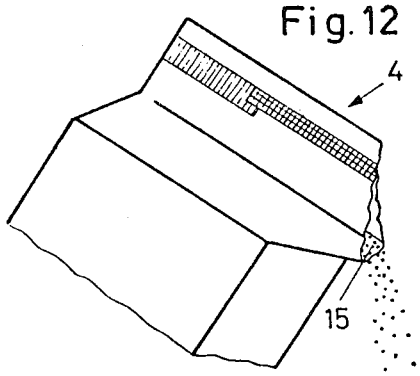
FIGS. 11 and 12 are perspective views illustrating the opening of the bag and the pouring of the contents therefrom.
Figure 13:
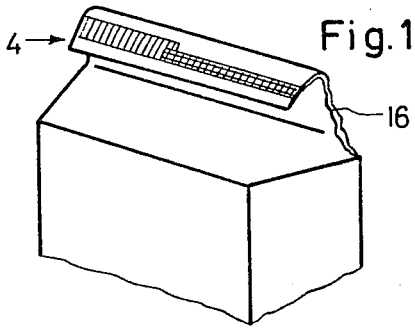
FIGS. 13, 14 and 15 are perspective views illustrating consecutive steps in reclosing the bag according to the invention.
Figure 14:
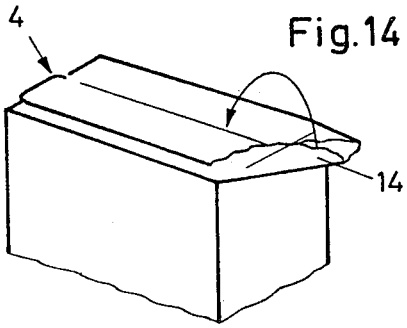
Figure 11:
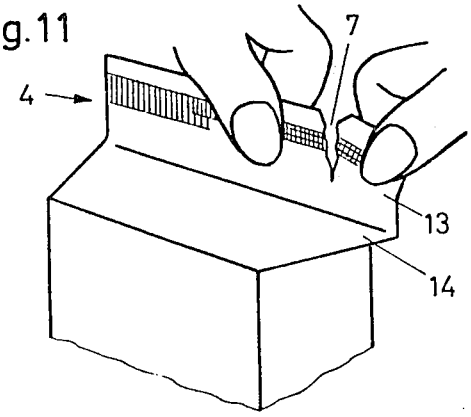
Figure 15:
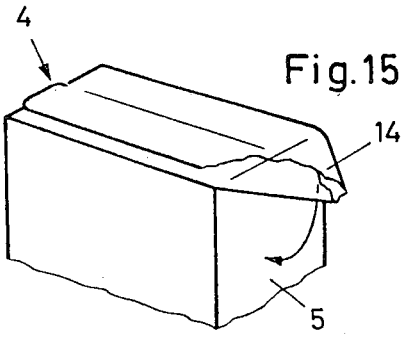

For opening the package, first the ear 10 is lifted and brought into a horizontal position as shown in FIG. 7. Thereafter, the closing flap 4 is lifted off the topside of the bag and is unfolded to bring it in a position illustrated in FIG. 4. Thereafter, as illustrated in FIG. 11, starting at the V-shaped notch 7, a portion 13 of the closing flap 4 is torn off. The triangular basic flap 14 remains largely intact. FIG. 12 illustrates the thus obtained pouring opening. For reclosing the bag, according to FIG. 13, the closing flap 4 is folded lengthwise, at which time the triangular flap 14 is folded upwardly onto the upper face of the package or laterally downwardly, as shown in respective FIGS. 14 and 15. In this manner the package is again closed for continued storage of the contents remaining therein.

The advantages of the above-described package reside in that without the use of a tool they can be easily torn open and again closed. The application of a closing tab is not necessary, thus economizing the costs that would be involved in such an additional manufacturing step. A warranty ribbon or the like may nevertheless be readily secured to the bag top.

It is to be understood that the above description of the present invention is susceptible to various modifications, changes and adaptations, and the same are intended to be comprehended within the meaning and range of equivalents of the appended claims.

What is claimed is:

1. A dual bag comprising in combination:

(a) an inner liner and an outer wrap;

2. A dual bag as defined in claim 1, wherein said cut is a V-shaped notch.

3. A dual bag as defined in claim 1, wherein said cut is a slit.

4. A dual bag as defined in claim 1, wherein said inner liner and said outer wrap are folded inwardly to form a pinch fold solely at one end of said closing flap; and further wherein the closing ear at another end of said closing flap, in the vicinity of said cut, is folded onto a lateral face of said bag.

5. A dual bag as defined in claim 4, wherein said transverse seam is formed of separate length portions; said pinch fold being sealed by one of said length portions.

6. A dual bag as defined in claim 1, wherein said closing flap is folded lengthwise onto itself and is secured to said upper face of said bag.

7. A dual bag as defined in claim 1, wherein said closing flap is arranged on and secured to said upper face in a lengthwise non-folded state.

8. A dual bag as defined in claim 1, wherein said closing ear is folded onto said closing flap and is secured thereto.

* * * * *

UNITED STATES PATENT AND TRADEMARK OFFICE

CERTIFICATE OF CORRECTION

PATENT NO. : 4,428,485

DATED : January 31, 1984

INVENTOR(S) : Alwin Egli

It is certified that error appears in the above-identified patent and that said Letters Patent is hereby corrected as shown below:

Claim 1, Column 4, after line 27, insert (b) a flatly pressed closing flap arranged in a face-to-face relationship with an upper face of the bag and having a closing ear at least at one end; said closing flap having an outer bounding edge; said closing flap being formed by portions of both said inner liner and said outer wrap;

(c) a transverse seam provided in the closing flap parallel to and spaced from said outer bounding edge for sealing said bag;

(d) said inner liner being under vacuum;

(e) a first seamless portion of said closing flap bounded by said outer bounding edge and said transverse seam;

(f) a second seamless portion of said closing flap extending in width from said upper face to said transverse seam; said transverse seam having a maximum width extending parallel to the width of said second seamless portion; said width of said second seamless portion being at least three times the maximum width of said transverse seam; and (g) a tear-starting cut extending into said closing flap from said outer bounding edge in the vicinity of said closing ear; said cut extending through said inner liner and said outer wrap; said cut being provided exclusively in said first seamless portion and being oriented in a direction transverse to said transverse seam and towards said closing ear for determining a tear path across said transverse seam in the direction of said closing ear.--.

UNITED STATES PATENT AND TRADEMARK OFFICE

CERTIFICATE OF CORRECTION

PATENT NO. : 4,428,485

DATED : January 31, 1984

INVENTOR(S) : Alwin Egli

It is certified that error appears in the above-identified patent and that said Letters Patent is hereby corrected as shown below:

Column 2, line 19, change "view" to --views--.
Column 3, line 27, change "ourwardly" to --outwardly--.

Signed and Sealed this

*Twenty-fourth* Day of *July 1984*

[SEAL]

*Attest:*

GERALD J. MOSSINGHOFF

*Attesting Officer* *Commissioner of Patents and Trademarks*